US005277466A

United States Patent [19]

Wall

[11] Patent Number: 5,277,466

[45] Date of Patent: Jan. 11, 1994

[54] GOLF BALL RETRIEVER

[76] Inventor: Arvel L. Wall, 11112 Manorview Cir., Dallas, Tex. 75228

[21] Appl. No.: 845,166

[22] Filed: Mar. 3, 1992

[51] Int. Cl.[5] ..... A63B 47/02

[52] U.S. Cl. ..... 294/19.2; 294/99.1

[58] Field of Search ..... 294/19.1, 19.2, 99.1; 273/32B; 273/32F; 273/162E; 150/160; 206/315.4

[56] References Cited

U.S. PATENT DOCUMENTS

| | | | |
|---|---|---|---|
| 1,696,817 | 12/1928 | St. John . | |
| 1,749,753 | 3/1930 | Cauffield | 294/99.1 X |
| 2,482,294 | 9/1949 | Sandor | 294/19.2 |
| 2,549,257 | 4/1951 | Staunt | 294/19.2 |
| 2,720,411 | 10/1955 | Fletcher | 294/99.1 X |
| 3,265,430 | 8/1966 | Jenkins | 294/99.1 X |
| 3,421,788 | 1/1969 | Smith | 294/19.2 |
| 3,462,184 | 8/1969 | Russell | 294/19.2 |
| 3,520,569 | 7/1970 | Anderson | 294/19.2 |
| 3,547,477 | 12/1970 | Young | 294/19.2 |
| 3,669,427 | 6/1972 | Curtis | 294/19.2 |
| 3,712,658 | 1/1973 | Yaresh | 294/19.2 |
| 3,743,338 | 7/1973 | Seeger | 294/19.2 |
| 3,810,669 | 5/1974 | Reid | 294/19.2 |
| 3,922,027 | 11/1975 | Nesselt | 294/19.2 |
| 3,938,570 | 2/1976 | Stewart | 150/160 |
| 4,046,413 | 9/1977 | Jeninga | 294/19.2 |
| 4,136,901 | 1/1979 | Walter | 294/19.2 |
| 4,180,288 | 12/1979 | Sievers | 294/19.2 |
| 4,310,189 | 1/1982 | Nihra | 294/19.2 |
| 4,322,939 | 4/1982 | McDonald | 294/19.2 X |
| 4,334,707 | 6/1982 | Phillips | 294/19.2 |
| 4,746,156 | 5/1988 | Kremer | 294/19.2 |
| 4,974,894 | 12/1990 | Dubow | 294/19.2 |

FOREIGN PATENT DOCUMENTS

| | | | |
|---|---|---|---|
| 1501997 | 10/1967 | France | 294/19.2 |

*Primary Examiner*—David M. Mitchell
*Assistant Examiner*—Dean Kramer
*Attorney, Agent, or Firm*—Baker & Botts

[57] ABSTRACT

A golf ball retriever (10) is provided including a shaft (12), a resilient wire (14) having a first end (18) and a second end (20) substantially parallel to the shaft (12), and a retaining member (16) holding the first end (18) and the second end (20) to the shaft (12). The resilient wire (14) has at least two loops (30) and (31) formed therein spaced at a distance slightly smaller than the diameter of a golf ball. The flexibility of resilient wire (14) allows the golf ball to squeeze through the loops (30) and (31) utilizing a minimal amount of force. The golf ball sits cradled between the loops (30) and (31) and can be easily extracted by slightly shaking the shaft to provide enough force for the golf ball to push through the loops (30) and (31).

9 Claims, 3 Drawing Sheets

GOLF BALL RETRIEVER

TECHNICAL FIELD OF THE INVENTION

This invention relates in general to implements for grasping objects and more particularly to a golf ball retriever for picking up golf balls from hard to reach areas.

BACKGROUND OF THE INVENTION

The prior art contains numerous types of golf ball retrievers for picking up golf balls from various locations. However, these prior art retrievers have suffered from various shortcomings which have severely restricted their widespread commercial acceptance. Many retrievers cannot pick up a golf ball in confined areas, such as holes and crevices, or from mud, sand, or murky waters. Some retrievers require that the retriever be precisely placed on the golf ball, relying on a trigger mechanism or cup device to grasp the golf ball. Other retrievers must be forcefully pushed on the golf ball which requires that the golf ball be on a relatively hard surface. Still other retrievers require manual extraction of the golf ball from the retriever. Many retrievers are expensive to manufacture and difficult to assemble and disassemble. Other difficulties involve positioning the retriever relative to the golf ball. Such positioning is accomplished by utilizing the end of the retriever as an aiming device. In many instances, the end of the reliever may be difficult to see due to where the golf ball is located. When stored within a golf bag, most retrievers can become entangled with other items within the bag causing the retriever to lose its functionality.

From the foregoing, it may be appreciated that a need has arisen for a golf ball retriever which is easy to manufacture and assemble, can be easily positioned relative to the golf ball, can grasp the golf ball in various retriever positions, and requires no manual intervention to extract the golf ball from the retriever. A need has also arisen for a retriever that can pick up a golf ball from confined areas or from mud, sand, or murky waters and can be stored without becoming entangled with other items within the bag.

SUMMARY OF THE INVENTION

In accordance with the present invention, a golf ball retriever is provided which substantially eliminates or reduces disadvantages and problems associated with prior golf ball retrievers.

The retriever includes a resilient wire having two ends substantially parallel to each other along opposite sides of a shaft. A retaining member fits snugly around the shaft holding the two ends of the resilient wire in place. In one embodiment, the resilient wire is formed such that it has at least two loops therein. Each loop has a space slightly smaller than the diameter of a golf ball and the distance between loops is also spaced slightly smaller than the diameter of the golf ball. The resiliency of the wire allows for entry of the golf ball into the retriever from various directions. The extraction of the golf ball is accomplished by applying a slight shaking action to the shaft forcing the golf ball to push through the loops and away from the retriever. Another embodiment of the retriever has a larger outer loop formed within the resilient wire to guide the ball to the loops spaced slightly smaller than the diameter of the golf ball. In other embodiments, the retaining member is large enough to assist in positioning the resilient wire in relation to the golf ball. Also, the retaining member can be multi-colored to assist in orienting the resilient wire in relation to the golf ball.

The present invention provides technical advantages over other golf ball retrievers within the prior art. One technical advantage is the ease in manufacturing and assembling the retriever due to the few parts required. Another technical advantage is in the extraction of the golf ball from the retriever without manual intervention. Another technical advantage is the use of the retaining member as a target to position and orient the resilient wire in relation to the golf ball. Still another technical advantage is the ability of the resilient wire to maintain its shape and cut through mud without affecting the functionality of the retriever. Yet another technical advantage is to store the retriever to avoid entanglement with items within a golf bag.

BRIEF DESCRIPTION OF THE DRAWINGS

For a more complete understanding of the present invention and the advantages thereof, reference is now made to the following description taken in conjunction with the accompanying drawings, wherein like reference numerals represent like parts, in which.

DETAILED DESCRIPTION OF THE INVENTION

Figure 1:
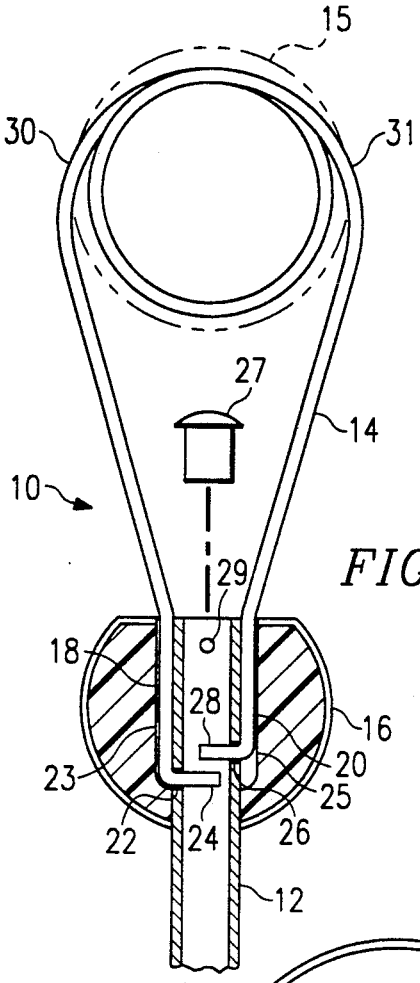
FIG. 1 is a plan view, partially in cross-section, of the golf ball retriever.

Referring to FIG. 1, there is illustrated a plan view, partially in cross-section, of a golf ball retriever 10 that is constructed in accordance with the invention. Retriever 10 is comprised of a shaft 12, a resilient wire 14, and a retaining member 16. Resilient wire 14 has a first end 18 and a second end 20 substantially parallel to each other and disposed along shaft 12. Shaft 12 has a first opening 22 through which a tip 24 of first end 18 protrudes. Similarly, shaft 12 has a second opening 26 through which a tip 28 of second end 20 protrudes. Retaining member 16 snugly fits around shaft 12 and holds first end 18 and second end 20 firmly against shaft 12 by means of grooves 23 and 25 provided in retaining member 16 extending to the vicinity of first opening 22 and second opening 26. In this manner, resilient wire 14 is held in a rigid position relative to shaft 12. Although not shown, shaft 12 will be several feet long and may telescope out to 10 or 12 feet in length.

For a shaft 12 having an open ended, hollow configuration, a plug 27 can be inserted into the open end of shaft 12 to prevent water from entering shaft 12. Plug 27 can be maintained in place by frictionally adhering to the inside of shaft 12 or by inserting a pin through pin hole 29 and into plug 27 to secure plug 27 in shaft 12. In another embodiment, pin hole 29 can extend through retaining member 16 to secure both plug 27 and retaining member 16 to shaft 12.

Figure 2:
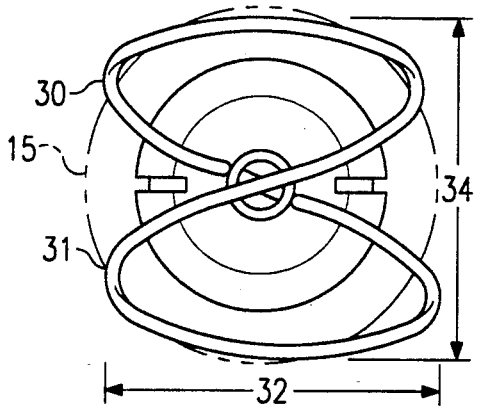
FIG. 2 is an enlarged end view of the retriever looking toward the end of the shaft.

In operation, retriever 10 is positioned such that resilient wire 14 can accept a golf ball 15 as shown by a dashed line. Resilient wire 14 has at least two loops 30 and 31 formed therein. FIG. 2 is an enlarged end view of retriever 10 and illustrates the spacing of loops 30 and 31 and the spacing between loops 30 and 31. Each of the loops 30 and 31 is spaced at a distance 32 slightly smaller than golf ball 15 and a distance 34 between loops 30 and 31 is also slightly smaller than golf ball 15. This spacing provides access for golf ball 15 into the retriever 10 from various directions. Access for golf ball 15 can be through loop 30, loop 31, or between loops 30 and 31 in an approximate 180° range across the leading edges of loops 30 and 31. Flexibility of resilient wire 14 allows golf ball 15 to squeeze through or between the slightly smaller loops 30 and 31 using a minimal amount of force. Golf ball 15 then becomes cradled between loops 30 and 31 and can now be carried away by retriever 10. Golf ball 15 can be easily extracted from retriever 10 by slightly shaking shaft 12 to provide enough force for golf ball 15 to squeeze through loops 30 and 31 of resilient wire 14. By using a single resilient wire, retriever 10 can cut through mud or sand to grasp a golf ball without the mud or sand inhibiting the grasping ability of retriever 10.

Retaining member 16 is formed to be highly visible to assist in positioning resilient wire 14 relative to golf ball 15. Though shown in a rounded shape, retaining member 16 can be formed into a variety of configurations. Retaining member 16 also can be multicolored to assist in orienting resilient wire 14 for appropriate grasping of golf ball 15. The targeting aspects of retaining member 16 allows a user to orient and place retriever 10 on golf ball 15 for grasping. Using retaining member 16 as a target, a user can retrieve golf balls in mud or murky waters or other low visibility areas easier than with prior art retrievers. Though not shown, a separate member may be used as the targeting device allowing retaining member 16 to hold resilient wire 14 onto shaft 12 in a variety of conventional manners.

Figure 4:
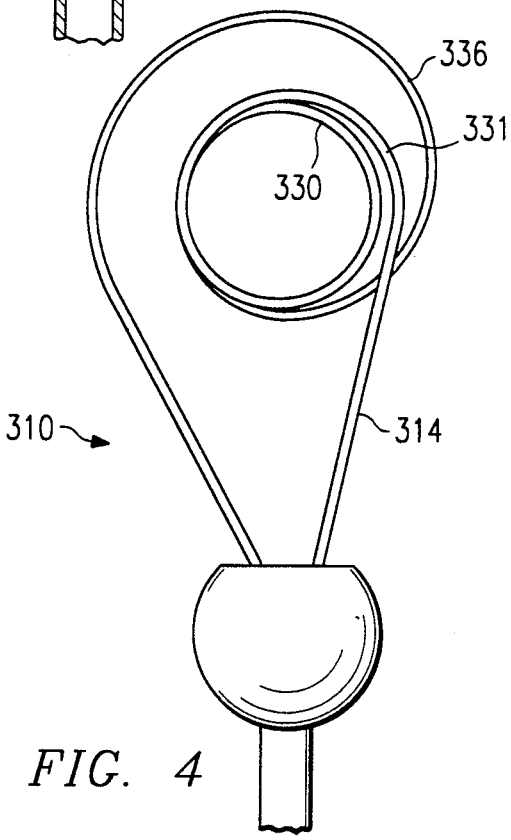
FIG. 4 is a plan view of another embodiment of the golf ball retriever which includes an outer loop formed within the resilient wire.
Figure 3:
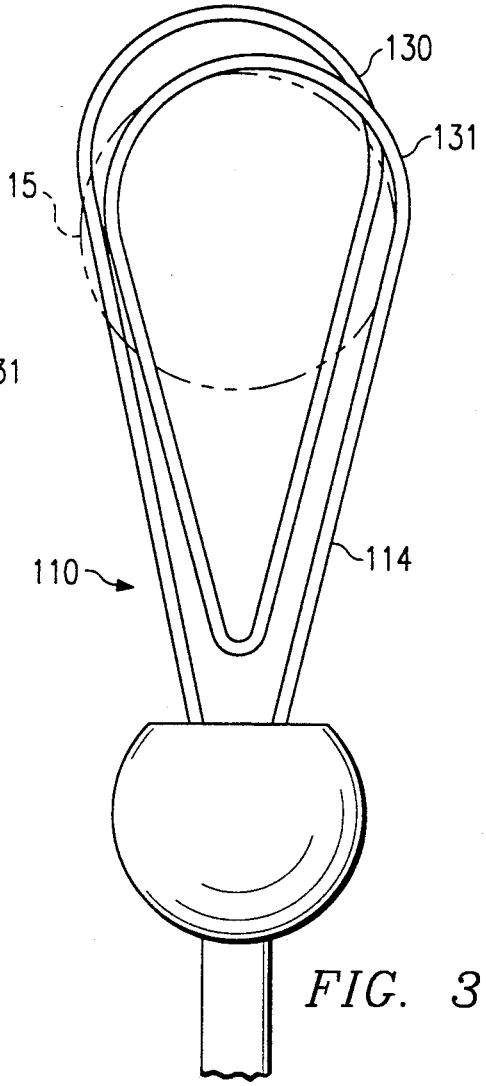
FIG. 3 is a plan view of another embodiment of the retriever.
Figure 3A:
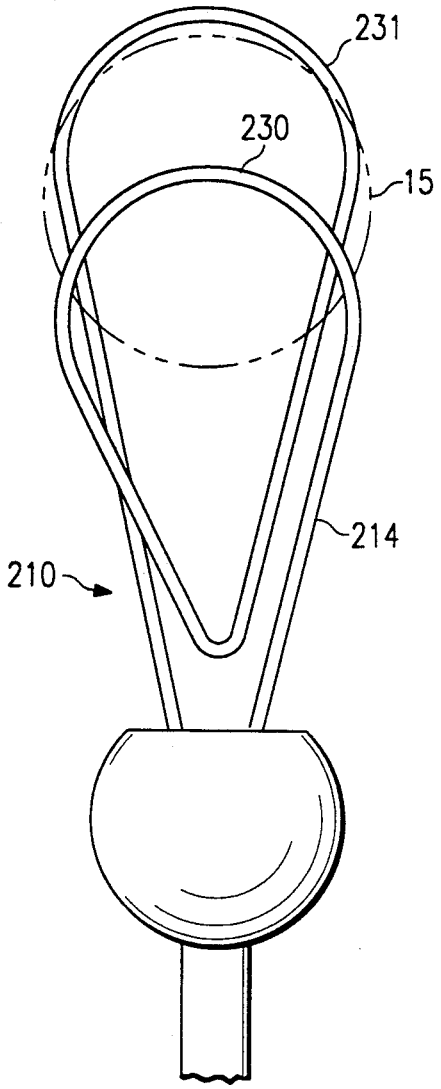
FIG. 3*a* is a plan view of a variation of the retriever of FIG. 3.
Figure 5:
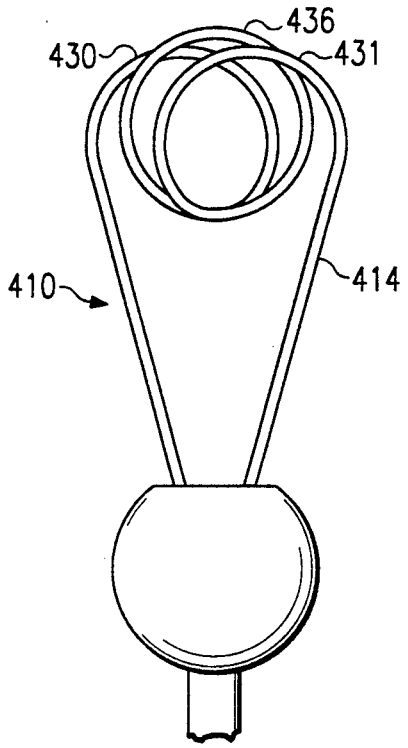
FIG. 5 is a plan view of another embodiment of the golf ball retriever which includes an inner loop formed within the resilient wire.

Resilient wire 14 may be formed in a variety of loop configurations. FIG. 1 illustrates a concentric circle type configuration of loops 30 and 31. FIG. 3 depicts a retriever 110 having a resilient wire 114 formed into an inverted tear drop shape of loops 130 and 131. Loops 130 and 131 are shown to be of approximate equal length. FIG. 3*a* depicts a variation of retriever 110. Retriever 210 has a resilient wire 214 formed into an inverted tear drop shape of loops 230 and 231. However, loop 230 is approximately one half a golf ball diameter shorter than loop 231. The shorter loop 230 acts as a guard to prevent golf ball 15 from inadvertently passing through both loops 230 and 231 without being grasped as could occur in retriever 110 of FIG. 3. FIG. 4 depicts a retriever 310 having a resilient wire 314 formed into an outer loop 336 larger than a golf ball that is arranged to guide a golf ball toward smaller loops 330 and 331 which are sized to retain a golf ball. FIG. 5 depicts a retriever 410 having a resilient wire 414 formed into an inner loop 436 larger than a golf ball and loops 430 and 431 which are sized to retain a golf ball. Inner loop 436 increases the grasping area formed by resilient wire 414 to prevent a golf ball from inadvertently passing through loops 430 and 431 without being grasped.

Figure 6:
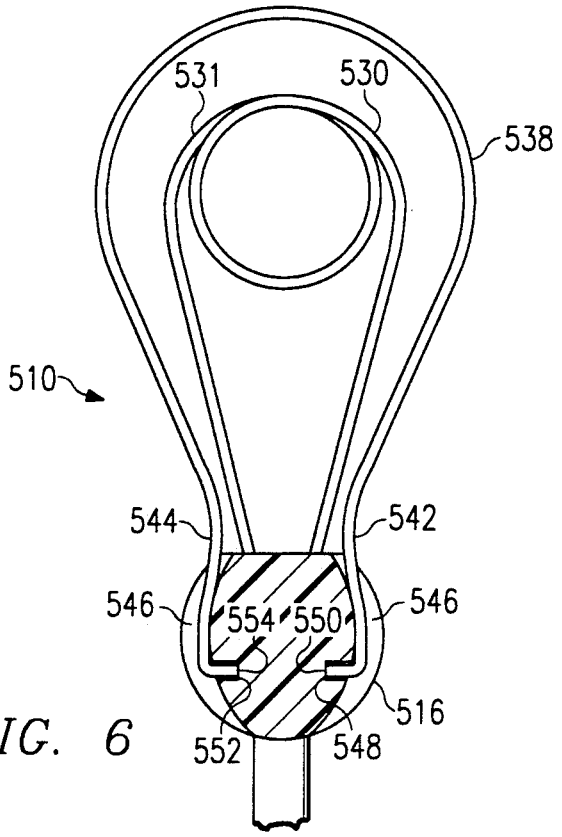
FIG. 6 is a plan view, partially in cross-section, of yet another embodiment of the golf ball retriever which includes a guide member protruding from the retainer means.
Figure 7:
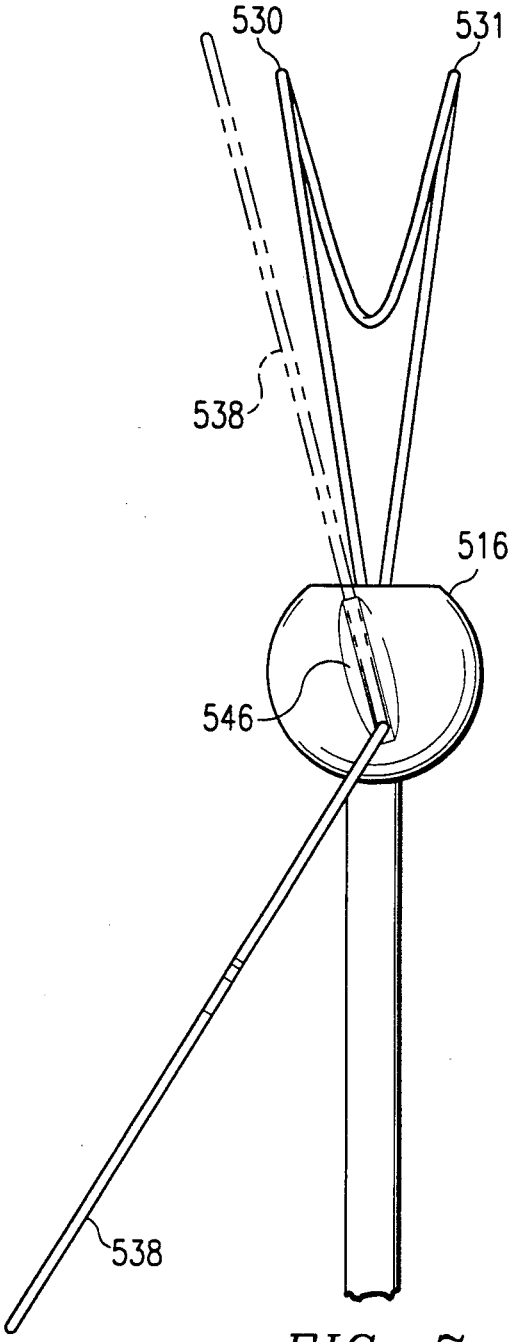
FIG. 7 is a side view of the golf ball retriever of FIG. 6 with the guide member pivoted away from the resilient wire.

FIGS. 6 and 7 depict a retriever 510 having a separate wire guide member 538 protruding from a modified retaining member 516 which guides a golf ball to loops 530 and 531 in a similar manner as outer loop 336 of FIG. 4. Wire guide member 538 has a first end 542 and a second end 544 that are disposed substantially parallel to each other along recesses 546 formed in retaining member 516. Retaining member 516 has a first opening 548 into which a tip 550 of first end 542 protrudes. Similarly, retaining member 516 has a second opening 552 into which a tip 554 of second end 544 protrudes.

FIG. 7 shows wire member 538 moved away from loops 530 and 531 for those situations where wire member 538 is too large for retrieving a golf ball located in confined areas. Wire member 538 pivots within first opening 548 and second opening 552 of retaining member 516. The frictional resistance between first end 542, second end 544, and retaining member 516 prevents wire member 538 from returning to the guide position along recesses 546 as represented by dashed lines when moved to the retracted position shown in solid lines in FIG. 7. Though not shown, another method of implementing wire member 538 is to have ends 542 and 544 extend through grooves 546 and beyond retaining member 516 such that tips 550 and 554 attach through holes in shaft 12 below retaining member 516. Wire member 538 is formed such that tip 550 of first end 542 and tip 554 of second end 544 are free of retaining member 516.

Figure 8:
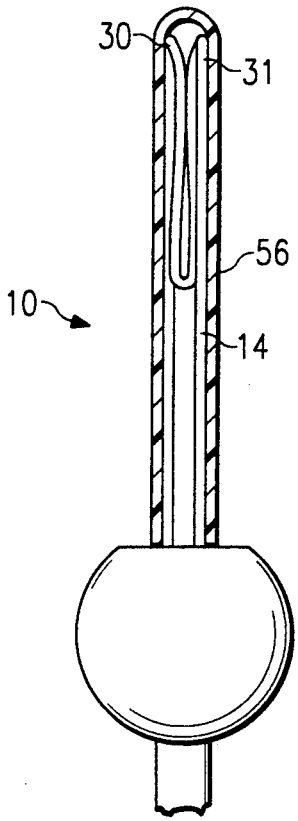
FIG. 8 is a sectional view of the golf ball retriever fitted with a storage cap.

FIG. 8 illustrates a storage cap 56 which encloses resilient wire 14 when retriever 10 is not in use. Resilient wire 14 snugly fits within storage cap 56. Storage cap 56 slides over resilient wire 14 moving loops 30 and 31 relatively together and holding loops 30 and 31 in a confined position. Storage cap 56 prevents retriever 10 from catching onto anything such as golf clubs, umbrellas, etc. Storage cap 56 may be formed to fit over any loop configuration of retriever 10. Storage cap 56 may also be formed to fit over wire member 538 of FIG. 6 if desired.

Thus, it is apparent that there has been provided, in accordance with the invention, a golf ball retriever that fully satisfies the object, aims, and advantages set forth above. Although the preferred embodiment has been described in detail, it should be understood that various changes, substitutions, and alterations, as a few have been described above, can be made therein without departing from the spirit and scope of the invention as defined by the following claims.

What is claimed is:

1. A golf ball retriever, comprising:

a shaft;

a single resilient wire having a first end and a second end, said first end and said second end substantially parallel to each other on opposite sides of said shaft, said resilient wire having a first grasping loop and a second grasping loop formed therein, said first and second grasping loops having a diameter slightly smaller than a diameter of a golf ball and are spaced apart a distance slightly smaller than said diameter of said golf ball, said resilient wire having at least one larger outer loop for guiding said golf ball to said first and second grasping loops; and retaining means for rigidly holding said first and second ends on said shaft by frictionally adhering to said shaft.

2. A golf ball retriever, comprising:

a shaft;

a single resilient wire having a first end and a second end, said first end and said second end substantially parallel to each other on opposite sides of said shaft, said resilient wire having a first grasping loop and a second grasping loop formed therein, said first and second grasping loops having a diameter slightly smaller than a diameter of a golf ball and are spaced apart a distance slightly smaller than said diameter of said golf ball, said resilient wire having at least one larger inner loop between said first and second grasping loops providing an extended area where said golf ball can be loosely trapped; and retaining means for rigidly holding said first and second ends on said shaft by frictionally adhering to said shaft.

3. A golf ball retriever, comprising:

a shaft;

a single resilient wire having a first end and a second end, said first end and said second end substantially parallel to each other on opposite sides of said shaft, said resilient wire having a first grasping loop and a second grasping loop formed therein, said first and second grasping loops having an inverted tear drop configuration, said first grasping loop being shorter in length than said second grasping loop; and retaining means for rigidly holding said first and second ends on said shaft by frictionally adhering to said shaft.

4. A golf ball retriever, comprising:

a shaft;

a resilient wire having first and second ends connected to said shaft, said resilient wire having a first grasping loop and a second grasping loop formed in a concentric circle configuration therein, said first and second grasping loops having a diameter slightly smaller than a diameter of a golf ball and spaced apart a distance slightly smaller than said diameter of said golf ball, said resilient wire having at least one larger outer loop for guiding said golf ball to said first and second grasping loops; and targeting means connected to said shaft, said targeting means having a multicolored body portion larger than said shaft for positioning and orienting said resilient wire relative to said golf ball.

5. A golf ball retriever, comprising:

a shaft;

a resilient wire having first and second ends connected to said shaft, said resilient wire having a first grasping loop and a second grasping loop formed in a concentric circle configuration therein, said first and second grasping loops having a diameter slightly smaller than a diameter of a golf ball and spaced apart a distance slightly smaller than said diameter of said golf ball, said resilient wire having at least one larger inner loop between said first and second grasping loops providing an extended area where said golf ball can be loosely trapped; and targeting means connected to said shaft, said targeting means having a multicolored body portion larger than said shaft for positioning and orienting said resilient wire relative to said golf ball.

6. A golf ball retriever, comprising:

a shaft;

a resilient wire having first and second ends connected to said shaft, said resilient wire having a first grasping loop and a second grasping loop formed in a concentric circle configuration therein, said first and second grasping loops having a diameter slightly smaller than a diameter of a golf ball and spaced apart a distance slightly smaller than said diameter of said golf ball;

targeting means connected to said shaft, said targeting means having a multicolored body portion larger than said shaft for positioning and orienting said resilient wire relative to said golf ball; and a removable cap for holding said first and second grasping loops in a flattened condition.

7. A golf ball retriever, comprising:

a shaft;

a resilient wire having first and second ends connected to said shaft, said resilient wire having a first grasping loop and a second grasping loop formed in a concentric circle configuration therein, said first and second grasping loops having a diameter slightly smaller than a diameter of a golf ball and spaced apart a distance slightly smaller than said diameter of said golf ball; and targeting means connected to said shaft, said targeting means having a multicolored body portion larger than said shaft for positioning and orienting said resilient wire relative to said golf ball, said targeting means having a guide member for guiding a golf ball to said resilient wire.

8. The retriever of claim 7 wherein said guide member pivots relative to said resilient wire.

9. A golf ball retriever, comprising:

a shaft;

a resilient wire having first and second ends connected to said shaft, said resilient wire having a first grasping loop and a second grasping loop formed in a concentric circle configuration therein, said first and second grasping loops having a diameter slightly smaller than a diameter of a golf ball and spaced apart a distance slightly smaller than said diameter of said golf ball, said first grasping loop being shorter in length than said second grasping loop; and targeting means connected to said shaft, said targeting means having a multicolored body portion larger than said shaft for positioning and orienting said resilient wire relative to said golf ball.

* * * * *